United States Patent [19]

Cartwright

[11] Patent Number: 4,523,967

[45] Date of Patent: Jun. 18, 1985

[54] INVERT EMULSION EXPLOSIVES CONTAINING A ONE-COMPONENT OIL PHASE

[75] Inventor: Richard V. Cartwright, Wantage Township, Sussex County, N.J.

[73] Assignee: Hercules Incorporated, Wilmington, Del.

[21] Appl. No.: 638,334

[22] Filed: Aug. 6, 1984

[51] Int. Cl.[3] ..... C06B 45/02

[52] U.S. Cl. ..... 149/2; 149/21; 149/45; 149/46; 149/60; 149/61; 149/70; 149/75; 149/76; 149/77; 149/83; 149/85; 149/92; 149/93; 149/96; 149/105; 149/108; 149/109.6

[58] Field of Search ..... 149/2, 21, 45, 46, 60, 149/61, 70, 76, 75, 77, 83, 85, 92, 93, 105, 108, 96, 109.6

[56] References Cited

U.S. PATENT DOCUMENTS

| | | | |
|---|---|---|---|
| 3,161,551 | 12/1984 | Egly et al. | 149/46 |
| 3,642,547 | 2/1972 | Conrad | 149/2 |
| 3,770,522 | 11/1973 | Tomic | 149/2 |
| 4,141,767 | 2/1979 | Sudweeks et al. | 149/2 |
| 4,216,040 | 8/1980 | Sudweeks et al. | 149/2 |
| 4,231,821 | 11/1980 | Sudweeks et al. | 149/2 |
| 4,322,258 | 3/1982 | Sudweeks et al. | 149/2 |
| 4,357,184 | 11/1982 | Binet et al. | 149/2 |
| 4,386,977 | 6/1983 | Ikeda | 149/2 |
| 4,414,044 | 11/1983 | Takeuchi | 149/2 |
| 4,428,784 | 1/1984 | Jessop et al. | 149/2 |

FOREIGN PATENT DOCUMENTS

| | | |
|---|---|---|
| 57-38394 | 3/1982 | Japan . |
| 57-188483 | 11/1982 | Japan . |
| 57-188485 | 11/1982 | Japan . |

*Primary Examiner*—Stephen J. Lechert, Jr.
*Attorney, Agent, or Firm*—John E. Crowe

[57] ABSTRACT

Method of maximizing stability and minimizing production of toxic fumes as explosion by-products by utilizing a moisture resistant blasting composition and said composition, comprising an invert emulsion component having, as the continuous external organic phase thereof, a partial ester of a 2–12 carbon polyhydric alcohol and a tall oil fatty acid, said explosive composition being capable of utilizing sufficient solid oxygen-supplying salt to obtain an Oxygen Balance of about zero without substantial loss of sensitivity.

23 Claims, No Drawings

INVERT EMULSION EXPLOSIVES CONTAINING A ONE-COMPONENT OIL PHASE

BACKGROUND

Within the last decade there has been a substantial movement away from the use of older explosive compositions such as TNT, dynamite, and nitroglycerin as blasting agents for hard rock mining, excavation, and similar commercial purposes, in favor of prilled ammonium nitrate (AN) or mixtures of ammonium nitrate with other oxygen containing inorganic salts, plus various carbonaceous fuels and sensitizers (ANFO).

Such explosive formulations use relatively cheap components, can be produced or constituted "in situ", and are much safer compared with traditional explosives since the usual long term storage and transportation problems are substantially avoided.

Where a bore hole is wet and deep, however, the above-listed advantages of AN and ANFO formulations become less attractive since much material is easily desensitized and must be protected (a) by special packaging, (b) by the addition of expensive AN coatings, and (c) by use of thickeners or gelling agents, and the like. Moreover, ANFO has somewhat limited blasting energy due to its low bulk density.

Some of the above problems of AN and ANFO formulations can be avoided, at least in part, by use of special slurries having an increased bulk density, but such compositions are usually not moisture proof, and must continue to rely upon gassification or similar art-recognized density control means to retain an acceptable level of sensitivity. Pressure conditions at the bottom of deep bore holes, however, tend to compress gas voids causing temporary loss of sensitivity and detonation failure, leaving unexploded charges in areas where further drilling, mining or excavation may be required.

A substantial breakthrough with respect to moisture resistance is described in U.S. Pat. No. 3,161,551 of Egly, in which is water-resistant blasting agent is obtained having at least one solid prilled inorganic salt (e.g. ammonium nitrate "AN"), treated with a water-in-oil emulsion having a 50–70% AN solution and an art-recognized hydrocarbon fuel, tall oil, long chain fatty acids or derivatives thereof as the continuous external hydrophobic phase, plus a hydrophobic w/o emulsifier.

Egly's composition exhibits substantial resistance to water because of the fact that the water-in-oil emulsion component fills most of the natural voids in the solid prilled ammonium nitrate salt component, and water cannot easily force its way through the continuous external hydrophobic phase of the emulsion. Package charges of this type can be more readily placed at the bottom of a column of water than ANFO composites, because their composite density is substantially greater than 1.0. This combination of high density and solid oxidizer salt, however, results in a substantial decrease in detonation rate and overall energy efficiency, plus an unaccountably low sensitivity. Moreover, over a period of time, the presence of such solid salt, particularly solid ammonium nitrate, may even promote crystal growth in the aqueous phase of the emulsion which, in turn, leads to even further loss in sensitivity and energy efficiency.

Bluhm (U.S. Pat. No. 3,447,978), representing a further development in this area, describes an improved class of explosive compositions generally falling within the category of water-in-oil emulsion blasting agents. Such consist essentially of (1) known water-in-oil emulsifiers;

(2) a discontinuous ammonium nitrate aqueous phase (optionally supplemented by other water soluble oxidizer salts) within a continuous organic phase consisting of a carbonaceous fuel having a predetermined gas-retaining consistency at 70° F.; and (3) a functionally important occluded gas such as air, or gas-entraining particles such as glass bubbles and the like, as a density control agent.

Bluhm's explosive compositions, while capable of avoiding some of the deep wet bore hole problems described above, also suffer from certain stability limitations and potential pollution problems because the proportion, by weight, of discontinuous aqueous phase to continuous organic phase must be high in order to even approximate a satisfactory Oxygen Balance. As a result, the oil films (continuous organic fuel and emulsifier phase) separating droplets of the discontinuous AN aqueous phase are very thin and easily broken by changes in ambient conditions, such as temperature and pressure variations. This, in turn, directly affects important explosive characteristics such as sensitivity.

Merely increasing the proportion of organic phase to aqueous phase, however, does not provide a satisfactory solution to Bluhm's problem since an increase in the organic phase inevitably results in a shift toward a negative Oxygen Balance, particularly if a substantial amount of packaging material such as polymeric film is required to retain or shape the charge.

The term Oxygen Balance (OB), as used above and hereafter, is conveniently defined percentage-wise by the formula $$OB=(G_o)/(G_x)\times 100$$

wherein $G_o$ is the number of grams of oxygen released (+) or oxygen required (−) in order to completely oxidize $G_x$ grams of the explosive formulations being tested.

For minimizing the formation of toxic or noxious by-product fumes, it is found that an overall Oxygen Balance of about −1% to +1% is required.

Water-in-oil type emulsifying agents, as separate components, are almost universally necessary in order to obtain stable formulations as exemplified in both Egly and Bluhm. Such may include fatty acid derivatives as listed, for instance, in U.S. Pat. Nos. 3,161,551, 3,447,978, 3,765,964, 4,110,134 and UK Pat. No. 1,306,546; nitrogen-containing surfactants such as ammonium salts as listed, for instance, in U.S. Pat. Nos. 4,026,738 and 4,141,767; oxazolines as listed in U.S. Pat. Nos. 4,216,040 and 4,322,258; hydroxyethyl-imidazolines as listed in U.S. Pat. No. 4,315,784; and taurates (e.g. U.S. Pat. No. 4,315,787).

Irrespective of one's choice of emulsifying agent, however, the need for ease in preparation and for storage stability under extreme ambient conditions has yet to be fully satisfied under Bluhm or other existing art teaching without also including a generous amount of a continuous organic phase. When provided, however, the resulting Oxygen Balance, as noted above, generally becomes substantially negative and dangerous toxic fumes are produced as a result.

It is an object of the present invention to obtain a class of explosive compositions which retain resistance to the deleterious effects of water and high pressure common to deep hole use.

It is a further object of the present invention to maximize both stability and explosive energy while maintaining acceptable booster sensitivity characteristics of a class of invert emulsion-containing explosive compositions.

It is a still further object to minimize the production of toxic and corrosive fumes produced as explosion by-products through use of an oxygen-balanced invert emulsion-containing blasting composition.

THE INVENTION

The above objects are obtained by utilizing a blasting composition comprising, (A) an invert water/oil emulsion component consisting essentially of
  (a) an internal discontinuous aqueous phase containing about 50–90 weight percent of a water soluble inorganic oxygen-supplying salt; and
  (b) an active amount of a continuous hydrophobic organic phase of a partial ester of a 2–12 carbon polyhydric alcohol esterified by a tall oil fatty acid;

(B) a solid oxygen-supplying inorganic salt to obtain an Oxygen Balance of about zero;

(C) 0% to about 50% by volume of a density control agent; and (D) 0% to about 40% by weight of a sensitizer.

For purposes of the present invention, the invert water/oil emulsion component (A) preferably utilizes
  (a) an internal discontinuous aqueous phase of about 10–20 weight percent water or higher, based on emulsion and containing the above-indicated weight percent range of dissolved inorganic oxygen-supplying salt. Such salt is usually ammonium nitrate (AN) alone or in combination with one or more supplemental water soluble inorganic oxygen-supplying salt, preferably in a ratio by weight of about 3–4 parts AN to 1 part supplemental salt.

Such supplemental water soluble inorganic salt can include, for instance, one or more of the group consisting of sodium nitrate, sodium chlorate, sodium perchlorate, calcium nitrate, calcium chlorate, calcium perchlorate, potassium nitrate, potassium chlorate, ammonium chlorate, ammonium perchlorate, lithium nitrate, lithium chlorate, lithium perchlorate, magnesium nitrate, magnesium chlorate, aluminum chlorate, barium nitrate, barium chlorate, barium perchlorate, zinc nitrate, zinc chlorate, and zinc perchlorate. For purposes of the instant invention ammonium nitrate and one or more of sodium nitrate and calcium nitrate are found particularly useful.

The aqueous phase, for present purposes, is conveniently formed by dissolving the salts into water conveniently heated up to about 110° F. or higher.

(b) an effective amount of the partially esterified continuous hydrophobic organic phase which can vary substantially, depending upon the degree of negative Oxygen Balance the system can tolerate and the degree of sensitivity required; generally speaking, however, an active amount consists of about 5–10, and preferably 5–7 weight percent, based on total emulsion.

The partial ester itself should have an HLB (hydrophile-lipophile) value of not more than about 5 and preferably about 2–5.

For purposes of the present invention the corresponding polyhydric alcohol component of such an ester can include, for instance, pentaerythritol, dipentaerythritol, glycerin or commercial mixtures thereof which are chemically capable of forming partial esters within the above-indicated HLB range.

Tall oil fatty acids especially suitable for present purposes contain from 85% to 96.8% fatty acids and minor amounts of rosin acids and unsaponifiables, the fatty acid component consisting of approximately equal amounts of oleic and linoleic acids. Such material is available commercially, for instance, under the Trademark PAMAK ® from Hercules Incorporated of Wilmington, Del.

Suitable tall oil fatty acids for purposes of the present invention, constitute a mixture obtainable as by-products from a sulfite wood pulping process and are commercially available, as noted above.

For identification purposes, partial esters of the present invention can also be conveniently described as those partial esters which fall within the general equation $$B=20(1-S/A)$$

(ref. page 244 of "Surfactants and Interfacial Phenomena", M. J. Rosen, John Wiley & Sons (1978)) in which the symbol "B" represents the HLB value; "S" represents the saponification value (i.e. number of mg. KOH to saponify an ester content of one gram of surfactant); and "A" represents the acid value of the fatty acid used to form the surfactant (i.e. number of mg. KOH to neutralize one gram of the fatty acid).

Utilizing the above formula, it is found that partial esters within the present invention generally have a saponification value within the range of about 140–174 (based on estimated acid values of 187–193 for Tall Oil Fatty Acids).

The suitable proportion of fatty acid to polyhydric alcohol required to fall within such range can be calculated by one skilled in the art.

The use of one or more of such partial ester(s) as a continuous oil phase of the emulsion component helps to avoid producing explosive compositions having an excessively negative Oxygen Balance. For example, the Oxygen Balance of a PAMAK 4 partial ester of pentaerythritol vries from −250% to −277%, with ester saponification values of 140 to 174 respectively. On the other hand, the Oxygen Balance of most frequently used hydrocarbon fuels in the art generally varies between about −333% and −353%, depending upon the precise composition. Consequently, an emulsion utilizing a hydrocarbon fuel with a standard organic w/o emulsifier as the continuous oil phase can be expected to have a strong negative Net Oxygen Balance. Such a balance favors the formation of dangerous toxic fumes.

The solid oxygen-supplying inorganic salt described above as component (B), is generally distinct by definition and physical condition from a soluble salt within the discontinuous aqueous emulsion phase identified above within component (A). The instant solid salt, when used in combination with the hydrophobic organic phase of the invert emulsion, can now be fully and effectively used for correcting a negative Oxygen Balance induced by polyethylene or other packaging materials and the continuous organic phase itself, without unduly destabilizing or desensitizing the resulting composition. The solid salt component is most conveniently but not exclusively utilized in an amount up to about 25 weight percent, or about 0.005–0.25 parts-to-1 and preferably in the amount of 0.5–10 weight percent based on the emulsion component.

Such solid salt includes, for instance, one or more of the group comprising ammonium nitrate, sodium nitrate, sodium chlorate, sodium perchlorate, calcium nitrate, calcium chlorate, calcium perchlorate, potassium nitrate, potassium chlorate, ammonium chlorate, ammonium perchlorate, lithium nitrate, lithium chlorate, lithium perchlorate, magnesium nitrate, magnesium chlorate, aluminum chlorate, barium nitrate, barium chlorate, barium perchlorate, zinc nitrate, zinc chlorate, and zinc perchlorate.

While the emulsion phase (A) and solid oxygen-supplying inorganic salt (B) comprise an important part of the instant invention, it is also found convenient, on occasion, to include up to a minor amount (i.e. 0% to about 50% by volume) of a density control agent and (D) 0% to about 40% by weight of a sensitizer of a non-metallic type such as particulate smokeless powder or as otherwise suggested below.

Density control agent(s) are found useful for purposes of the present invention when a relatively long exposure, under stringent deep hole conditions, is anticipated prior to firing and heat or other conditions prohibit or severely restrict the concurrent use of a sensitizer component. For most purposes, however, it is found advantageous to utilize no more than minimal amounts of density control agent within the range of 0–20% and preferably not exceeding 3% by volume.

Such agents include, for instance, hollow or porous particles such as glass spheres, styrofoam beads, plastic microballoons, fused or sintered agglomerates and the like, which are well known to the art and readily available commercially, for instance, under the trademarks Q-Cel®, Microperl®, Extendospheres®, Fillite®, and Sil-Cell®.

Relatively small amounts of these agents can be conveniently incorporated, as desired, to obtain a blasting composition having a density range of about 1.17 to 1.35 gm/ml and preferably about 1.20 gm/ml.

Sensitizer components (component D supra) are found useful for assuring consistent sensitivity while still complying with precise firing characteristics and explosive energy needs of compositions within the scope of the present invention. Suitable sensitizers of the non-metallic type include, for instance, particulate smokeless powder such as fines, trinitrotoluene, pentaerythritol tetranitrate, 2,4,6-trinitro-N-methylaniline, cyclotetramethylene tetranitramine, nitrostarch, monomethylamine nitrate, ethylenediamine dinitrate, and explosive-grade nitrocellulose.

Smokeless powder may also be used in combination with one or more of the other above-listed sensitizer components, when desired.

While the pH of blasting compositions of the present invention may vary substantially, it is found that a pH within the range of 1–5 is preferred.

The following examples further illustrate preferred embodiments of the present invention, all percentages being by weight unless otherwise indicated.

EXAMPLE I

To 494 grams of an ester/alcohol mixture consisting of pentaerythritol/dipentaerythritol (90/10 by weight) partially esterified[1] by a tall oil fatty acid[2], is added, with stirring[3], 7153 grams of mixed nitrate salts in the form of an aqueous solution consisting of the ammonium (61%) and sodium (19%) salts. After one minute, a coarse water-in-oil (w/o) emulsion is obtained which is then passed through an homogenizer. The resulting fine w/o emulsion is then gently admixed with sufficient hollow silicate material[4], as density control agent, to obtain a composition density of about 1.20. The Oxygen Balance of the resulting packaged composition[5] is found to be −0.93%. The formulation is routinely tested for sensitivity[6], detonation velocity[7], and explosive energy[8], and the results reported in Table I below.

EXAMPLE II

The w/o emulsion of Example I (7,000 gm) is gently admixed with 385 grams of solid prilled ammonium nitrate salt and sufficient hollow silicate density control agent[4] to obtain a composition density of 1.20. The resulting product is tested as in Example I and the results reported in Table I below.

EXAMPLE III

Example I is repeated using 494 gm of a glycerin/tall oil fatty[2] acid ester (33% esterified) having a saponification value of 157 and an HLB value of 4.2. The composition is homogenized and combined with sufficient density control agent[4], to obtain a density of about 1.17 and a packaged Oxygen Balance of about +0.22[5]. The resulting formulation is tested as before and the results reported in Table I below.

EXAMPLE IV

Example I is repeated using 494 gm of a 90/10 pentaerythritol/dipentaerythritol partial ester (37% esterified) having a saponification value of 153 and an HLB value of 4.2 as the organic emulsion phase. The emulsion is then combined with sufficient density control agent[4] to obtain a composition density of about 1.20 and a packaged Oxygen Balance of about −0.18%[5]. The formulation is tested as before and results reported in Table I below.

EXAMPLE V

The emulsion prepared as in Example IV (6371 grams) is admixed with 329 grams of solid prilled ammonium nitrate and sufficient density control agent[4] to obtain a composition density of 1.2. The resulting formulation has an Oxygen Balance of +0.65%. The resulting product is tested as before and the results reported in Table I.

EXAMPLE VI

Example I is repeated using 494 gm of a partial ester (37%) of pentaerythritol and PAMAK 4A having an HLB value of 4.1, in place of the partial mixed ester of Example I. The resulting formulation density 1.20 is tested as before and the results reported in Table I below.

EXAMPLE VII

Example I is repeated but replaced the partial ester thereof with 494 gm of a mixture of a 30/70 part dipentaerythritol/pentaerythritol 40% esterified with PAMAK 4A and having an HLB value of 4.0. The resulting formulation is tested as before and the results reported in Table I.

EXAMPLE VIII

Example VII is repeated but with the addition of 250 gm ammonium nitrate to 7000 gm emulsion and sufficient density control agent to obtain a density of 1.20.

The resulting product has a packaged Oxygen Balance of +0.26%. The resulting formulation is tested as before and reported in Table I.

EXAMPLE IX

An emulsion is made from 581 gm of the same partial ester used in Example III and 8419 gm of aqueous solution of the same composition as in Example I. Emulsification conditions are the same as in Example I. To 8000 gm of the emulsion is added 3428 gm smokeless powder fines (a by-product of smokeless powder manufacturing) and 2994 gm prilled ammonium nitrate. No density control agent is added. The resulting mixture was stirred to obtain a uniform consistency, tested as before, and reported in Table I.

EXAMPLE X (Control)

The emulsification step of Example I is repeated using 333 grams of mineral oil[9], 115 grams of sorbitan sesquioleate[10] (HLB value of 3.7) and 46 grams of oleic acid diethanolamide emulsifier[11] as the oil phase, plus an aqueous phase consisting of 7153 grams of an 80% aqueous solution of ammonium nitrate/sodium nitrate (3.32:1 by weight). To the resulting emulsion blend is added sufficient density control agent[4] to obtain a composition density of 1.20. The Oxygen Balance of the resulting product is found to be −3.57%[5]. The formulation is tested as before and the results reported in Table I.

[1]Saponification Value 174; HLB value 2.5; 59% esterified;
[2]Obtained commercially from Hercules Incorporated of Wilmington, Del. under the Trademark PAMAK ® 4A
[3]750 rpm; Model ES Jiffy Mixer ® from Jiffy Mixer Co. Irvine, CA.;
[4]Obtained commercially from PQ Corporation, Valley Forge, PA. under the trademark Q-Cel ® 300;
[5]Using 0.8% by weight of polyethylene film as packaging;
[6]Based on gm PETN required for detonation;
[7]meters/second; 4" diameter charge;
[8]cal/gm (underwater).
[9]Obtainable commercially from Exxon Corporation under the Univolt 60 ® mark.
[10]Available commercially as Emsorb ® 2502
[11]Available commercially as Emid ® 6545

TABLE I

| Example | Oil Phase | HLB | Gm/ml Density *13 | Sensitivity, gm PETN | Detonation Velocity (m/sec) *14 | Oxygen Balance *15 | Explosive Energy (cal/g) | Solid Additives *12 |
|---|---|---|---|---|---|---|---|---|
| I | Pentaerythritol/ Dipentaerythritol 90/10 ester (59% esterified) | 2.5 | 1.20 | 10 | 5550 | −0.93% | 577 | — |
| II | Pentaerythritol/ Dipentaerythritol 90/10 ester (59% esterified) | 2.5 | 1.20 | 25 | 5100 | −0.01% | 595 | 5.1% AN |
| III | Glycerin ester (33% esterified) | 4.2 | 1.17 | 25 | 5300 | +0.22% | 590 | — |
| IV | Pentaerythritol/ Dipentaerythritol 90/10 ester (37% esterified) | 4.2 | 1.20 | 10 | 5550 | −0.18% | 607 | — |
| V | Pentaerythritol/ Dipentaerythritol 90/10 ester (37% esterified) | 4.0 | 1.20 | 150 | 5550 | +0.65% | 615 | 4.8% AN |
| VI | Pentaerythritol (37% esterified) | 4.1 | 1.20 | 7 | 5700 | −0.22% | 579 | — |
| VII | Pentaerythritol (70)/ Dipentaerythritol (30) (40% esterified) | 4.0 | 1.17 | 7 | 5700 | −0.29% | 582 | — |
| VIII | Pentaerythritol (70/ Dipentaerythritol (30) (40% esterified) | 4.0 | 1.20 | 25 | 5500 | +0.26% | 590 | 3.4% AN |
| IX | Pentaerythritol (90)/ Dipentaerythritol (10) (33% esterified) | 4.2 | 1.34 | 200 (confined) | 4650 | −0.90% | 702 | 20.8% AN plus 23.8% smokeless powder fines |
| X (Control) | Mineral Oil*16 +Sorbitan Sesquioleate*10 +Oleic acid diethanolamide *11 | 3.7 | 1.20 | 10 | 5550 | −3.57% | 627 | — |

*12 Other than density control agent.
*13 Density control agent, when used, available as Q-Cel ® 300.
*14 4" diameter charge.
*15 Including .8% by weight polyethylene packaging.
*16 Available commercially from Exxon Corp. under Univolt 60 ® mark.

What is claimed is:

1. A blasting composition comprising
(A) an invert water/oil emulsion component consisting essentially of
(a) an internal discontinuous aqueous phase containing about 50–90 weight percent of a water soluble inorganic oxygen supplying salt; and
(b) an effective amount of a continuous hydrophobic organic phase of a partial ester of a 2–12 carbon polyhydric alcohol esterified by a tall oil fatty acid,
(B) a solid oxygen-supplying inorganic salt to obtain an Oxygen Balance of about zero,
(C) 0% to about 50% by volume of a density control agent; and
(D) 0% to about 40% by weight of a sensitizer.

2. The blasting composition of claim 1 wherein the water soluble inorganic oxygen-supplying salt in the internal discontinuous aqueous phase of the invert emulsion component comprises ammonium nitrate alone or in combination with one or more supplemental water soluble inorganic oxygen-supplying salt.

3. The blasting composition of claim 2 wherein the sensitizer comprises particulate smokeless powder fines.

4. The composition of claim 2 wherein the ratio by weight of ammonium nitrate to supplemental water soluble inorganic oxygen-supplying salt is about 3–4 parts to 1.

5. The blasting composition of claim 2 wherein the Oxygen Balance is maintained within the range of about +1% to −1%, and the continuous hydrophobic organic phase of the emulsion has an HLB value of not more than about 5.

6. The blasting composition of claim 3 wherein the ratio by weight of solid oxygen-supplying inorganic salt (B) to invert emulsion component is about 0.01–0.50 parts to 1, and the density control agent does not exceed 3% by volume.

7. The blasting composition of claim 3 wherein the ratio by weight of solid oxygen-supplying inorganic salt (B) to invert emulsion component is about 0.01–0.50 parts to 1 and the density control agent is 0%–20% by volume.

8. The blasting composition of claim 5 wherein the supplemental water soluble inorganic oxygen-supplying salt of the invert emulsion component is one or more of sodium nitrate, sodium chlorate, sodium perchlorate, calcium nitrate, calcium chlorate, calcium perchlorate, potassium nitrate, potassium chlorate, ammonium chlorate, ammonium perchlorate, lithium nitrate, lithium chlorate, lithium perchlorate, magnesium nitrate, magnesium chlorate, aluminum chlorate, barium nitrate, barium chlorate, barium perchlorate, zinc nitrate, zinc chlorate, or zinc perchlorate; and the continuous organic phase consists of partially esterified pentaerythritol, dipentaerythritol, glycerin or mixtures thereof having an HLB value of about 2–5.

9. The blasting composition of claim 2 wherein the solid oxygen-supplying inorganic salt (B) is present in the amount of about 0.1–10 weight percent, based on the emulsion component.

10. The blasting composition of claim 5 wherein the solid inorganic oxygen-supplying salt (B) is at least one member selected from the group consisting of ammonium nitrate, sodium nitrate, sodium chlorate, sodium perchlorate, calcium nitrate, calcium chlorate, calcium perchlorate, potassium nitrate, potassium chlorate, ammonium chlorate, ammonium perchlorate, lithium nitrate, lithium chlorate, lithium perchlorate, magnesium nitrate, magnesium chlorate, aluminum chlorate, barium nitrate, barium chlorate, barium perchlorate, zinc nitrate, zinc chlorate, and zinc perchlorate.

11. The blasting composition of claim 2 wherein the density control agent (C) comprises hollow or porous particles.

12. The blasting composition of claim 7 wherein solid oxygen-supplying inorganic salt component (B) does not exceed about 0.5% by weight based on emulsion component.

13. A method for maximizing stability and booster sensitivity and minimizing formation of toxic fumes as explosion by-products, comprising utilizing the blasting composition of claim 1.

14. A method for maximizing stability and booster sensitivity and minimizing formation of toxic fumes as explosion by-products, comprising utilizing the blasting composition of claim 2.

15. A method for maximizing stability and booster sensitivity and minimizing toxic fumes as explosion by-products, comprising utilizing the composition of claim 3.

16. A method for maximizing stability and booster sensitivity and minimizing toxic fumes as explosion by-products, comprising utilizing the composition of claim 5.

17. A method for maximizing stability and booster sensitivity and minimizing toxic fumes as explosion by-products, comprising utilizing the composition of claim 6.

18. A method for maximizing stability and booster sensitivity and minimizing toxic fumes as explosion by-products, comprising utilizing the composition of claim 7.

19. A method for maximizing stability and booster sensitivity and minimizing toxic fumes as explosion by-products, comprising utilizing the composition of claim 8.

20. A method for maximizing stability and booster sensitivity and minimizing toxic and corrosive fumes as explosion by-products, comprising utilizing the composition of claim 9.

21. A method for maximizing stability and booster sensitivity and minimizing formation of toxic fumes as explosion by-products, comprising utilizing the blasting composition of claim 10.

22. A method for maximizing stability and booster sensitivity and minimizing formation of toxic fumes as explosion by-products, comprising utilizing the blasting composition of claim 11.

23. A method for maximizing stability and booster sensitivity and minimizing formation of toxic fumes as explosion by-products, comprising utilizing the blasting composition of claim 12.

* * * * *